United States Patent [19]

Balaskas

[11] Patent Number: 4,509,407

[45] Date of Patent: Apr. 9, 1985

[54] HYDRAULIC CONTROL VALVE WITH MAINTENANCE-FACILITATING FEATURE

[75] Inventor: Spyros Balaskas, Bremen, Fed. Rep. of Germany

[73] Assignee: Vereinigte Flugtechnische Werke GmbH, Bremen, Fed. Rep. of Germany

[21] Appl. No.: 501,414

[22] Filed: Jun. 6, 1983

[30] Foreign Application Priority Data

Jun. 15, 1982 [DE] Fed. Rep. of Germany ..... 3222435

[51] Int. Cl.[3] ..... F15B 13/042; F15B 15/26

[52] U.S. Cl. ..... 91/466; 91/41; 91/418; 137/624.27

[58] Field of Search ..... 91/418, 41, 466; 137/624.27, 106

[56] References Cited

U.S. PATENT DOCUMENTS

| | | | |
|---|---|---|---|
| 2,276,979 | 3/1942 | Jacobi | 137/625.25 |
| 3,285,284 | 11/1966 | Junck et al. | 137/624.27 |
| 3,680,583 | 8/1972 | Clair | 137/624.27 |
| 3,698,434 | 10/1972 | Nelson | 137/624.27 |

*Primary Examiner*—Robert E. Garrett
*Assistant Examiner*—H. Edward Li
*Attorney, Agent, or Firm*—Ralf H. Siegemund

[57] ABSTRACT

The control valve for an hydraulic actuator is provided with a particular operating state for venting the hydraulic system, which state is attainable positively whenever the hydraulic pressure is inadequate, e.g., in the case of venting or presence of air bubbles; a pressure-monitoring element permits positively the slide element of the control valve to be placed into the venting disposition, in that a particular stop on the slide rod cooperates with a plunger extending from the monitoring cylinder and being subject to the differential force between a spring and system pressure.

2 Claims, 1 Drawing Figure

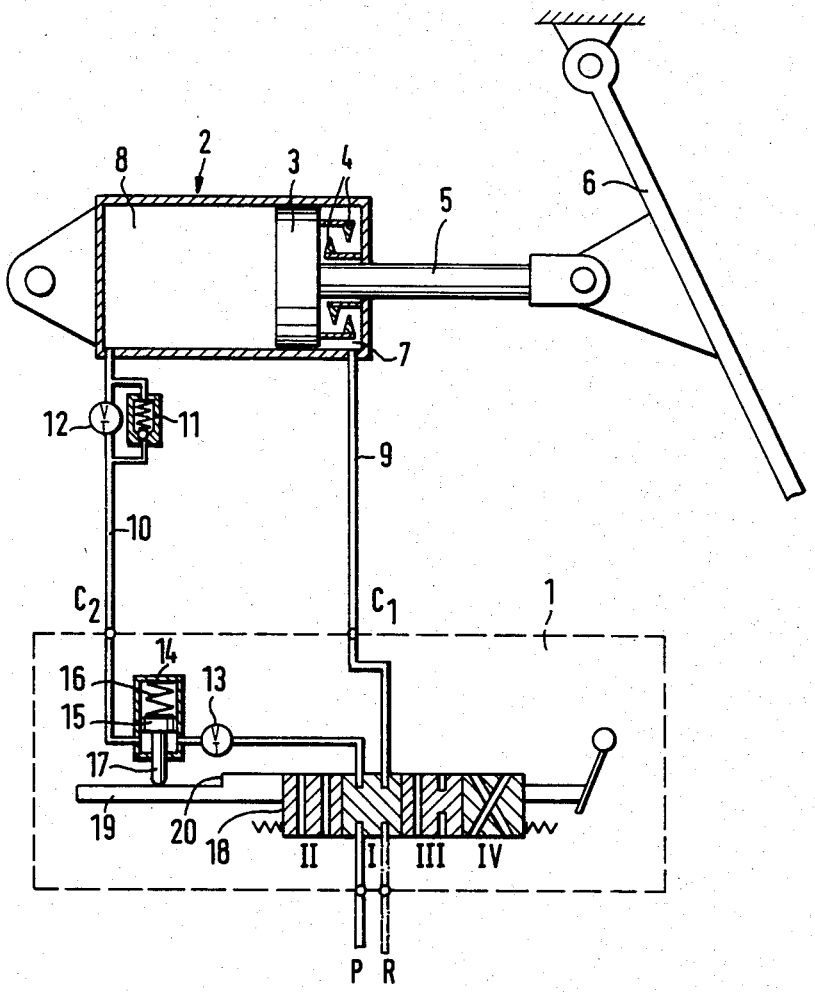
2
8
3
4
5
6
7
12
11
9
10
C2
C1
1
14
16
13
15
17
19
20
18
II
I
III
IV
P
R

HYDRAULIC CONTROL VALVE WITH MAINTENANCE-FACILITATING FEATURE

BACKGROUND OF THE INVENTION

The present invention relates to the valve control of a hydraulic actuator, wherein multiple, adjustable control positions are provided for the selective control of passage and blocking of the flow of hydraulic fluid through supply and return ducts.

The utilization of more or less complex control valves controlling a hydraulic actuator entails that, from time to time, certain maintenance work has to be performed. Such valves are, for example, used in the aircraft industry, and maintenance here is, of course, required for reasons of safety and has to be performed regularly and periodically in order to ensure that the aircraft is consistently operational in all of its functions. It is obvious that components requiring such maintenance and here particularly control valves in the hydraulic system should be constructed to permit such maintenance with ease. Moreover, it has to be observed that the valves are part of a, more or less, complex hydraulic system; after the maintenance work on the valves has been completed, the hydraulic system has to be vented and recharged with hydraulic fluid, but any accidental inclusion, for example, of air bubbles in the hydraulic fluid has to be avoided positively as that may have fatal effects.

Considering the foregoing requirements, it has been customary in the aircraft industry to provide particularly located and constructed venting valves within the hydraulic actuator system of the aircraft. These venting valves are located between the outputs of regular control valves and the hydraulic actuator to be operated by the control valves. These suppplemental venting valves do, indeed, ensure the complete removal of air bubbles from the hydraulic system. On the other hand, the expenditure as such is too high, i.e., it is deemed undesirable to provide a separate valve just for purposes of venting the system! Not only do such venting valves constitute additional components, they add also weight; and of course, they have their own maintenance requirements. For this reason, a valve has been constructed in which a regular control valve is modified to include in a separate and additional operational state for the venting function. It was found, however, that in practice this type of valve posed problems because maintenance people may not always exercise due care in the adjustment of the valve concerning the venting disposition. Therefore, it has been found in practice that, even though a valve was presumed to have been placed in a venting position, the venting function had not been completely performed and that, after maintenance was supposedly completed, air bubbles were still included in the hydraulic system, particularly air bubbles trapped in relatively high-positioned components.

DESCRIPTION OF THE INVENTION

It is an object of the present invention to provide a new and improved control valve for hydraulic control systems, for example, in aircraft which, in a simple manner, is still capable of providing the venting function in a, more or less, foolproof manner.

It is a principal feature of the invention to incorporate the venting function for a hydraulic control system, into the control valve, and to establish monitoring conditions which positively place that valve into the venting state whenever venting is required.

In accordance with the preferred embodiment of the present invention, it is suggested that a control valve be constructed regularly and in accordance with the desired and requisite control function, but is provided with a slide member having a stop in order to determine the venting disposition. A monitoring device includes a plunger and is operationally associated with the glide and slide member. The plunger is connected to a spring-loaded piston which, in turn, cooperates with and slides inside a positioning cylinder having just one side connected to a conduit between the control valve and the controlled actuator. The piston-operated plunger thus establishes a particular control state for the valve whenever there is a pressure drop in the said conduit due to, for example, a venting state or because inadvertently an air bubble has been introduced into the hydraulic control system so that a venting and refilling step of the hydraulics is, indeed, required! The hydraulic actuator may be constructed as a device operating with a differential piston in which case the monitoring cylinder is connected to the cylinder chamber portion partioned off by the differential piston, but being *not* traversed by the actuator rod. Moreover, the slide element of the control valve could be constructed as a rod or as a disk.

The inventive features supplement a control valve in which the venting is produced in a simple manner, simply upon impact of the slide member against the plunger of the monitoring cylinder (in the case air bubbles are present). During the normal operating state, the plunger is lifted by the effective system pressure whereby any minor and ineffective air bubbles that may be present are compressed so that subsequently the control valve can indeed assume all possible operating and switching positions.

DESCRIPTION OF THE DRAWINGS

While the specification concludes with claims, particularly pointing out and dinstinctly claiming the subject matter which is regarded as the invention, it is believed that the invention, the objects and features of the invention, and further objects, features and advantages thereof will be better understood from the following description taken in connection with the accompanying drawings, in which:

The FIGURE illustrates in section view and as a system diagram an example of the preferred embodiment of the present invention for practicing the best mode thereof.

Proceeding now to the detailed description of the drawing, the FIGURE shows a control valve or valve system 1 cooperating with an actuator which includes a cylinder 2 in which is movable a differential piston 3. The piston 3 is illustrated in one extreme position, to the right, whereby supplemental latching elements 4 lock the position of the differential piston, and here particularly of the piston rod 5 extending to one side of the piston 3 and being linked to a load element 6. In the present example, it is assumed, for example, that 6 is the cargo hatch of an aircraft, but this is, of course, only one example of hydraulic actuation; an aircraft is provided with numerous components, aspects, and features requiring hydraulic actuation, and the inventive system is applicable to all of them.

The control valve or valve system 1 is amenable to assume four switching and operating states and positions, designated by numerals I, II, III, and IV. The valve is illustrated in the switch position I. In this particular position, system pressure P as well as the return path R of the actuator 2 are separated so that the differential piston 3 does, in fact, remain in the illustrated operating position in which it is locked anyhow. The control valve system 1 has two inputs, designated by characters P and R, through which operating hydraulic pressure is applied as well as hydraulic fluid is returned to the supply system, as is inherent in the designating letters.

The valve system 1 has, in addition, two outputs, designated by characters C1 and C2. The hydraulic output C1 is connected by means of a conduit 9 to the operating chamber 7, which is situated on one side of differential piston chamber of the system 2-3. The output C2 is connected by means of a conduit 10 to the chamber 8 of actuator cylinder 2. The conduit path 10 includes a check valve 11 bypassed by a throttle 12. Another throttle, 13, is provided within the control valve system 1, i.e., in the connection leading to the output C2. The same connection includes a lateral branch for a cylinder 14 of a monitoring device and having a piston 15. The piston 15 is slideably disposed in the cylinder 14, and the chamber of the cylinder 14 to one side of the piston 15 is inserted in the conduit that leads to the output C2. The other side of the piston 15 is biased by means of a compression spring 16.

The control valve system 1 is illustrated to have the operating position I, in which both output C1 and C2 are separated from both inputs P and R. In this case, the spring 16 exerts a force upon the piston 15, which places the piston into one particular limit position. It should be noted that this is the same situation that occurs if air bubbles are included in the hydraulic system so that, in fact, the residual hydraulic pressure or none at all acts upon the piston 15, and the spring 16 can decompress to the fullest extent possible.

The piston 15 is provided with a plunger 17, projecting beyond the confines of the cylinder 14 and engaging a slide rod 19, being connected with and to the slide element 18 of the control valve system 1. The rod 19 is provided with a stop 20 which blocks further displacement of the rod to the left if, in fact, the plunger 17 is protracted as illustrated. In other words, if for any reasons the entire assembly 19-18 moves to the left and if the pin 17 is in the fully projected position, stop 20 prevents further advance of the slide element 18 to the left. The stop 20 and the position of the element 14 in relation to the plunger 17 is chosen so that if, in fact, the stop 20 abuts plunger and pin 17 the valve system 1 is the switch position III.

Switching and operating position III is provided for purposes of venting the system. It can be seen that in this particular instance the output C2 is connected, through the throttle 13, to the pressure line P while the connection between the return part R and the output C1 is interrupted. The slide 18 has, in addition, two other operating positions, designated by II and IV. In the operating position II, pressure is applied to the output C2, while output C1 connects the other side of an operating and actuating cylinder 2 to the return parts R. In position IV, the relationships are reversed.

In operation, and considering normal operations when maintenance is not required, monitoring piston 15 is under the influence of the system pressure acting against the spring 16 and, therefore, retracting the plunger stop 17. This means that the control slide 19 can move freely past the plunger 17, and particularly the stop 20 will not abut at the plunger. Thus, the valve slide 19 can assume any of the operating positions I through IV. It can readily be seen that in the operating position II the cargo hatch 6 is placed into the illustrated position; and in the operating position IV, the cargo hatch 6 is retracted because the differential plunger 3 is pulled into the cylinder 2, provided the lock 4 has been relesed separately, which is a safety feature and has nothing to do with the aspects of the invention.

During maintenance operation, air may enter the hydraulic system. Nothing particularly positive has to be provided for in this regard; the entrance of air into the system is simply an inevitable effect of maintenance work. This means that the conduit 10 and the line generally which includes the exit C2 is, more or less, depressurized. The spring 16 will push the plunger 17 forward into abutment with the left-hand portion of the slide 19. The venting position is simply attained by pulling the rod 19 to the left. No particular accuracy is necessary because the displacement of slide rod 19 is limited by the projecting plunger 17. Therefore, as long as the rod 19 is pulled to some extent, the slide will be forced to assume the switching position III. As stated, this is the venting position of the system, and venting can now be obtained and provided for in the usual manner. After the hydraulic system has been refilled with hydraulic fluid, the plunger 17 is retracted by necessity of the inherent system operation which, in turn, permits subsequently the slide 18 to assume any desired position.

The invention is not limited to the embodiments described above; but all changes and modifications thereof, not constituting departures from the spirit and scope of the invention, are intended to be included.

I claim:

1. A system including a valve and a hydraulic actuator, the valve including a valve slide element adjustable to assume different operating positions to, thereby, establish different hydraulic operating states for the actuator, the actuator having a chamber with a piston movable therein, there being a first and a second conduit for connecting the valve to the chamber, respectively, on opposite sides of the piston, the improvement comprising:

the valve slide element having in addition a venting position for the actuator for opening conduction into the first conduit, but not into the second conduit;

a slide rod connected to the valve slide and being provided with a step;

a spring-loaded second piston and a second chamber, the chamber being inserted in one of said conduits between the control valve and the actuator such that pressure in the conduit tends to urge the second piston against the spring force; and a plunger connected to the second piston and having a disposition to stop the slide rod by abutment against said step in the venting position equivalent to and providing for a venting operation as between the control valve and the actuator if substantial air bubbles are contained in the system, so that system pressure is insufficient to retract the second piston and its plunger, full operating pressure in said one conduit being effective to retract said second piston with the plunger for unrestraint positioning of the slide element through its rod in any of the operating positions.

2. The control valve and system as in claim 1, wherein said conduit, in which said chamber is inserted, runs from the control valve to that side of the hydraulic actuator chamber which is not traversed by an actuator piston rod.

* * * * *